United States Patent [19]

Bigley et al.

[11] 3,989,169

[45] Nov. 2, 1976

[54] AUTOMATIC SELF-LEVELING FLUID DISPENSER

[75] Inventors: John J. Bigley; Philip J. Gaughan, both of Philadelphia, Pa.

[73] Assignee: Betz Laboratories, Inc., Trevose, Pa.

[22] Filed: June 13, 1975

[21] Appl. No.: 586,679

[52] U.S. Cl. ..... 222/207

[51] Int. Cl.[2] ..... B65D 37/00

[58] Field of Search ..... 222/64, 158, 207, 215; 141/18, 29, 116, 119

[56] References Cited

UNITED STATES PATENTS

| | | | |
|---|---|---|---|
| 1,993,001 | 3/1935 | Geyer | 222/158 |
| 2,730,270 | 1/1956 | Heinmann | 222/207 X |
| 2,744,663 | 5/1956 | White | 222/207 |
| 3,064,863 | 11/1962 | Mattson | 222/207 X |
| 3,134,515 | 5/1964 | Callahan, Jr. | 222/215 X |
| 3,145,876 | 8/1964 | McBrien | 222/158 X |
| 3,661,189 | 5/1972 | Bowser et al. | 141/116 X |

*Primary Examiner*—Allen N. Knowles
*Assistant Examiner*—Hadd Lane
*Attorney, Agent, or Firm*—Alexander D. Ricci; Steven H. Markowitz

[57] ABSTRACT

The present invention is directed to a self-leveling fluid container or dispenser.

The invention can be specifically illustrated as it applies to an automatic self-leveling zero burette. A hole is drilled in a wall of the burette approximately on top of the zero graduation line. A piece of plastic tubing with a saddle base serves as a sleeve. The saddle base of the sleeve is connected to the hole in the burette. A length of plastic tubing has a first end thereof connected to the other end of the sleeve. A second end of the length of plastic tubing is inserted through a tight fitting hole in the cap of a squeeze bottle and is extended to near the bottom of the bottle. The squeeze bottle serves as fluid reservoir for fluid to be fed to the burette. When the squeeze bottle containing the fluid to be fed to the burette is depressed the fluid travels up the length of tubing and into the burette. By simply releasing the pressure on the squeeze bottle, all fluid in the burette above the zero line is sucked back into the reservoir bottle.

19 Claims, 2 Drawing Figures

AUTOMATIC SELF-LEVELING FLUID DISPENSER

BACKGROUND OF THE INVENTION

The present invention is directed to fluid containers or dispensers, and in particular to graduated burettes. More specifically, the present invention provides a novel assembly for feeding fluid to a container or dispenser, which assembly also automatically adjusts the level of fluid in the container or dispenser to a predetermined level. In this regard reference is made to U.S. Pat. Nos. 2,158,102; 1,993,001; 3,145,876; and 844,686 which comprehensively describe the feeding and automatic leveling apparatus which are available in the burette art.

The available prior art self-leveling burette assemblies have many drawbacks. The prior art assemblies generally comprise a separate fluid reservoir, aspirator bulb and overflow tubing, thus rendering rather cumbersome assemblies. The rigid glass parts of the prior art assemblies are fragile and are generally not replaceable. Since the fluid reservoir is fixidly positioned to a rigid feeding tube, removal of the reservoir for filling of the same is difficult. Generally speaking, the prior art assemblies use intricate plumbing systems to perform the burette filling and self-leveling functions, thus rendering systems of substantial weight and complexity. Furthermore, such intricate plumbing systems generally utilize numerous valves and petcocks, thus presenting a substantial maintenance requirement for the systems. The prior art assemblies generally cannot be transported without first emptying the fluid from the reservoir. Also, if a liquid is stored in a prior art glass reservoir and is frozen, the reservior will break. Generally speaking, the various parts of the prior art assemblies are packaged and shipped separately and must be assembled before use.

SUMMARY OF THE INVENTION

Accordingly, it is an object of the present invention to provide a novel self-leveling system for a fluid container or dispenser. The present invention has a particularly useful application in providing a self-leveling burette assembly which overcomes the above-noted drawbacks related to prior art self-leveling burette assemblies.

According to one feature of the present invention, the filling tube between the dispenser and fluid reservoir is also the automatic-leveling tube and the fluid reservoir also serves as an aspirator thus rendering an extremely simple, compact assembly.

According to another feature of the present invention a flexible connecting tube between the fluid reservoir and dispenser is provided which connecting tube is unbreakable and facilitates easy detachment of the fluid reservoir from the assembly. Furthermore, the flexible connecting tube permits movement of the fluid reservior during operation of the assembly.

According to an additional feature of the present invention an all plastic assembly is provided which is unbreakable and lightweight.

Another important feature of the present invention relates to an extremely simplified plumbing system which, in the case of a burette, requires only one valve or petcock.

Additionally, the present invention features a self-leveling burette assembly which can be easily transported since a simple clamping of the flexible connecting tube permits transportation of the reservoir with fluid contained therein. And even though the reservoir may be transported full of fluid, the reservoir can nonetheless be transported in either a horizontal or a vertical position.

According to still a further feature of the present invention, the self-leveling burette assembly can be transported completely assembled.

Additionally, the present invention accomodates the use of many different fluid reservoirs each containing a different reagent for use with a single burette.

Finally, since the assembly of the present invention is so simple and compact, only simple packaging for shipment of the assembly is required.

DETAILED DESCRIPTION

Figures 1, 2:
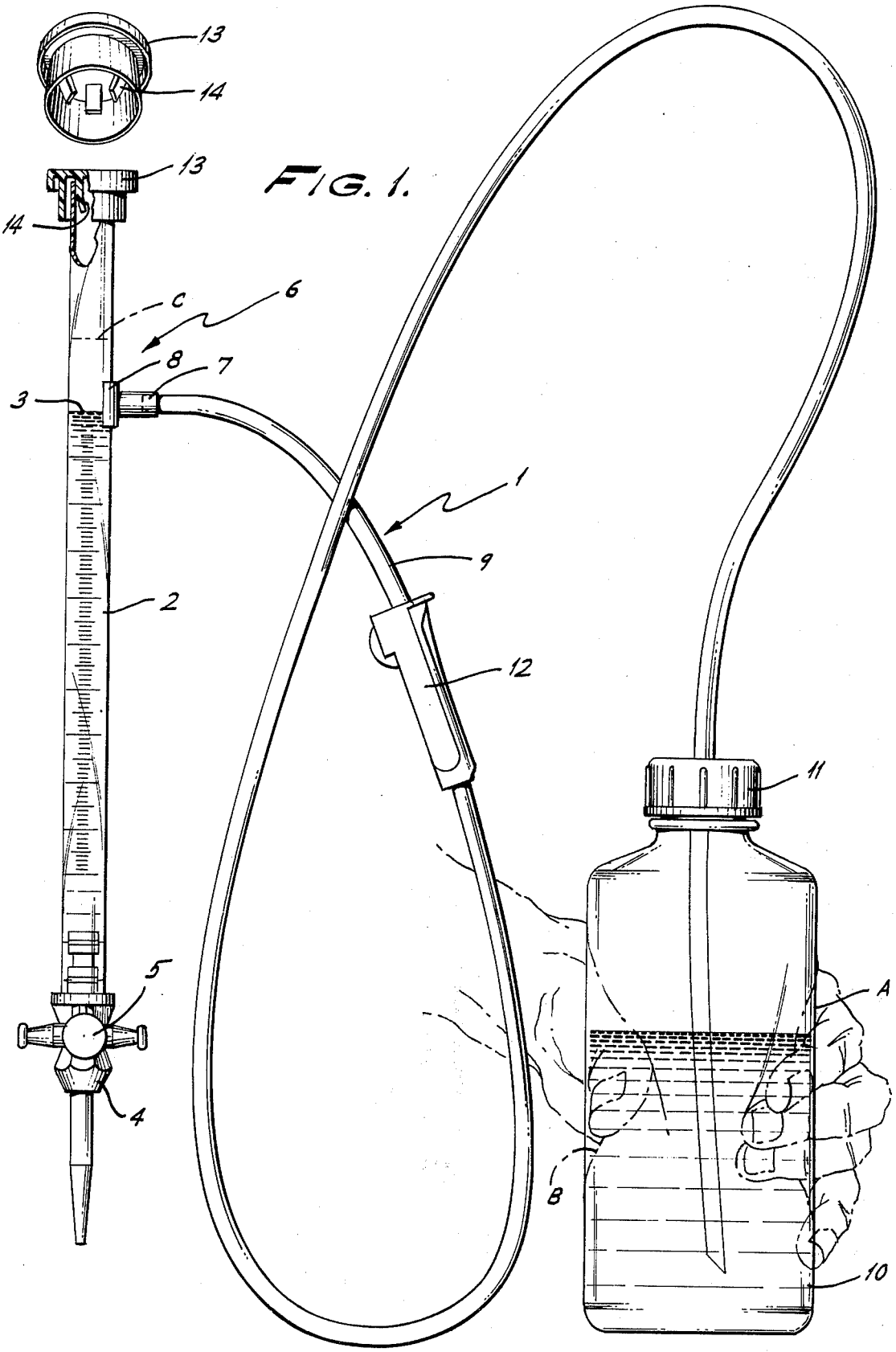
FIG. 1 is a side elevational view of the present invention as it applies to a self-leveling burette assembly.
FIG. 2 is a perspective view of an overflow cap of the burette assembly shown in FIG. 1.

As seen in FIG. 1 of the drawing, 1 generally indicates a self-leveling burette assembly according to the present invention.

Element 2 is a graduated burette column with the pre-determined zero-level indicated at 3. Preferably, the burette is made of a non-breakable material such as plastic. For example, a 25 ml. acrylic burette column could be used with each ml. indicated along the side thereof by a line. At the bottom of the graduated burette column is a stopcock arrangement which comprises a barrel 4 and a plug 5. Since the details of operation and structure of the stopcock are well known, such details are not included in the present description. However, it is noted that a polymethylpentene barrel and a teflon plug joined to the column with o-ring seals have been found to be particularly well suited for use with the assembly of the present invention due to low maintenance requirements, ease of use and durability. As is well known in the art, the stopcock is operated to dispense an accurately measured quantity of liquid from the burette column 2 which column has beforehand been carefully filled with the liquid up to the zero-point 3.

According to the present invention, a hole is provided in the burette column 2 at a location just on top of the zero-point 3. Connected to the hole is a saddled sleeve member 6. The saddled sleeve member 6 comprises sleeve 7, preferably plastic tubing, which is connected to one end to a saddled plate 8 which plate is contoured to fit flush like a saddle against the wall of the burette column 2. Saddle plate 8 has an opening aligned with the hole in the column 2 so as to maintain fluid flow communication between sleeve 7 and burette column 2. The hole in column 2 can be drilled.

Element 9 is a length of tubing, preferably flexible plastic tubing, which is connected at one end thereof to sleeve 7. While the drawing illustrates tubing 9 as being inserted into sleeve 7, it is to be understood that any suitable arrangement for providing a fluid flow arrangement between tubing 9 and burette column 2 can be provided. For examle, tubing 9 might fit over sleeve 7, or tubing 9 might be connected directly to the column 2. A 16 inches long piece of tygon tubing has been found to be suitable for use with the present inventive assembly.

A second end of tubing 9 is received in fluid reservoir 10. The fluid reservoir illustrated in the drawing is flexible such that fluid can be fed therefrom into burette column 2 by simply squeezing the reservoir as shown by phantom lines B. The fluid reservoir is preferably a flexible plastic reservoir such as a polyethylene bottle. A common plastic squeeze bottle with a screw-on cap has been found to be suitable for use with the present inventive assembly. It is preferable that bottle cap 11 have a hole therein through which tubing 9 can simply be inserted for use.

The operation of the inventive assembly is as follows:

With the plug 5 in a non-fluid flow position, the fluid to be dispensed from burette column 2 is fed thereto by simply squeezing fluid reservoir 10 as shown by the phantom lines B in the drawing. Upon squeezing of reservoir 10, the fluid travels up the tubing 9 and into the burette column. When the level of fluid in the burette column 2 exceeds the zero-point 3, as shown by the phantom line C, the fluid reservoir is released and all fluid above the zero-point is automatically sucked back into the reservoir 10.

Since the tubing 9 serves simultaneously as the filling and self-leveling tube and fluid reservoir 10 also serves as an aspirator, it is apparent that the present assembly is extremely simple and compact when compared to prior art assemblies.

As already noted, the flexible tubing 9 of the present invention is unbreakable as compared to prior art glass tubing. However, if for some reason tubing 9 is damaged it is easily detached from burette column 2 and fluid reservoir 10 and new flexible tubing is easily reattached. Also, due to the flexibility of tubing 9, the reservoir 10 can be moved about for use.

Since the tubing 9 can readily be detached from burette column 2, fluid reservoirs containing different fluids can be readily be interchanged for use with a single burette column.

The present inventive assembly requires little or no maintenance since only one petcock or valve is used.

To facilitate ease of transportation, a clamp 12 can be provided on tubing 9. By closing the clamp 12 and emptying the burette column 2, the assembly can be transported in the assembled condition and with the reservoir 10 containing fluid. Thus, the assembly is ready for immediate use.

Also, to prevent a geyser effect if too much fluid is squeezed from the reservoir 10 into column 2, an oversized cap 13 is inserted in the top of the burette column to direct overflow downwardly along the outside of the column. The oversized cap is retained in the opening at the top of the column by downwardly extending prongs 14. The cap 13 is shown in perspective in FIG. 2 of the drawing.

Having thus described the invention, what is claimed is:

1. An automatic zeroing burette assembly comprising:

a burette column having an upper zero level and aperture means in a side wall of said column at said zero level, fluid reservoir supply means for containing fluid in use, and conduit means connecting said aperture means and said fluid reservoir supply means in fluid flow communication, wherein said fluid reservoir supply means is of the type wherein positive and negative pressure may be generated, such that fluid may be delivered into said column to a level above said zero level and then drawn back to said zero level, wherein said fluid reservoir supply means is independently moveable in use with respect to said burette column, and wherein said conduit means extends externally between said fluid reservoir supply means and said burette column.

2. An assembly according to claim 1, wherein said conduit means is flexible.

3. An assembly according to claim 2, wherein said conduit means is detachably connected to said aperture means.

4. An assembly according to claim 3, wherein said conduit means is plastic.

5. An assembly according to claim 4, wherein a saddle sleeve means is attached to said aperture means, and wherein a first end of said conduit means is received by said saddle sleeve means.

6. An assembly according to claim 5, wherein a second end of said conduit means is connected to said fluid reservoir supply means.

7. An assembly according to claim 5, wherein said fluid reservoir supply means is a flexible squeeze bottle.

8. An assembly according to claim 2, wherein said conduit means is plastic.

9. An assembly according to claim 8, wherein a saddle sleeve means is attached to said aperture means and wherein a first end of said conduit means is received by said saddle sleeve means.

10. An assembly according to claim 9, wherein a second end of said conduit means is connected to said fluid reservoir supply means.

11. An assembly according to claim 2, wherein a saddle sleeve means is attached to said aperture means, and wherein a first end of said conduit means is received by said sleeve means.

12. An assembly according to claim 11, wherein a second end of said conduit means is connected to said fluid reservoir supply means.

13. An assembly according to claim 12, wherein said fluid reservoir supply means is a flexible squeeze bottle.

14. An assembly according to claim 2, wherein said fluid reservoir supply means is a flexible squeeze bottle.

15. An assembly according to claim 2, wherein said fluid conduit means comprises a single conduit.

16. An assembly according to claim 1, wherein said squeeze bottle and said burette means are plastic, and wherein a length of plastic tubing interconnects said squeeze bottle and said burette means to yield said fluid flow communication therebetween.

17. An assembly according to claim 16, wherein a plastic saddle sleeve connected to said aperture means receives one end of said plastic tubing.

18. An assembly according to claim 1, wherein said fluid is a liquid.

19. An assembly according to claim 1, wherein said fluid reservoir supply means is a flexible squeeze bottle.

* * * * *